US011208730B2

(12) United States Patent
Sonoda et al.

(10) Patent No.: US 11,208,730 B2
(45) Date of Patent: Dec. 28, 2021

(54) COMPOSITE PLATED PRODUCT AND METHOD FOR PRODUCING SAME

(71) Applicant: DOWA METALTECH CO., LTD., Tokyo (JP)

(72) Inventors: Yuta Sonoda, Tokyo (JP); Yukiya Kato, Tokyo (JP); Hiroto Narieda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 0 days.

(21) Appl. No.: 16/810,963

(22) Filed: Mar. 6, 2020

(65) Prior Publication Data

US 2020/0299852 A1 Sep. 24, 2020

(30) Foreign Application Priority Data

Mar. 18, 2019 (JP) ..... JP2019-049376

(51) Int. Cl.

| | |
|---|---|
| ***B32B 15/00*** | (2006.01) |
| ***C25D 3/46*** | (2006.01) |
| ***C25D 15/00*** | (2006.01) |
| ***C25D 5/12*** | (2006.01) |

(52) U.S. Cl.

CPC ..... *C25D 3/46* (2013.01); *C25D 5/12* (2013.01); *C25D 15/00* (2013.01); *Y10T 428/12493* (2015.01)

(58) Field of Classification Search

None

See application file for complete search history.

(56) References Cited

U.S. PATENT DOCUMENTS

| | | | | |
|---|---|---|---|---|
| 5,290,422 | A * | 3/1994 | Michelsen-Mohammadein | C25D 15/02 205/109 |
| 7,858,178 | B2 * | 12/2010 | Sander | C25D 15/02 428/331 |
| 2006/0130998 | A1 * | 6/2006 | Ludtke | C04B 35/634 165/42 |
| 2006/0135281 | A1 * | 6/2006 | Palumbo | C25D 1/00 473/316 |
| 2007/0007497 | A1 * | 1/2007 | Miyazawa | C25D 15/02 252/500 |
| 2009/0159451 | A1 * | 6/2009 | Tomantschger | C25D 15/00 205/96 |
| 2014/0094072 | A1 * | 4/2014 | Seki | C25D 15/00 439/887 |

FOREIGN PATENT DOCUMENTS

| | | | |
|---|---|---|---|
| JP | 03253598 | A | 11/1991 |
| JP | 05505853 | A | 8/1993 |
| JP | 097445 | A | 1/1997 |
| JP | 2006037225 | A | 2/2006 |
| JP | 2006169609 | A * | 6/2006 |
| JP | 2007016251 | A | 1/2007 |
| JP | 2007262528 | A | 10/2007 |

* cited by examiner

*Primary Examiner* — Seth Dumbris

(74) *Attorney, Agent, or Firm* — Bachman and Lapointe PC; George Coury

(57) ABSTRACT

There are provided a composite plated product, which has little uneven appearance and good wear resistance, and a method for producing the same without the need of any cyanide-containing silver-plating solutions and any silver-plating solutions containing silver nitrate as a silver salt. A sulfonic-acid-containing silver-plating solution, to which a carbon particle dispersing solution (preferably containing a silicate) is added, is used for electroplating a base material (preferably made of copper or a copper alloy) to form a composite plating film of a composite material, which contains the carbon particles in a silver layer, on the base material to produce a composite plated product.

7 Claims, No Drawings

COMPOSITE PLATED PRODUCT AND METHOD FOR PRODUCING SAME

BACKGROUND OF THE INVENTION

Field of the Invention

The present invention generally relates to a composite plated product and a method for producing the same. More specifically, the invention relates to a composite plated product which is used as a material of sliding contact parts such as switches and connectors.

Description of the Prior Art

Conventionally, as materials of sliding contact parts such as switches and connectors, there are used silver-plated products wherein a conductive material such as copper or a copper alloy is plated with silver in order to prevent oxidation of the conductive material due to heating in sliding processes.

However, there is a problem in that silver-plating films are easily stripped by sliding since they are soft and easy to wear and since they generally have high coefficients of friction. In order to solve this problem, there is proposed a method for improving the wear resistance of a conductive material by forming a coating film of a composite material on the conductive material by electroplating, the composite material containing graphite particles which are chosen from among carbon particles, such as graphite particles and carbon black particles, having good heat resistance, wear resistance, lubricity and so forth and which are dispersed in a silver matrix (see, e.g., JP H09-007445 A). There is also proposed a method for producing a silver-plating film, which contains graphite particles, by means of a plating bath to which a wetting agent suitable for the dispersion of graphite particles is added (see, e.g., JP H05-505853 A (National Publication of Translated Version of PCT/DE91/00241)). Moreover, there is proposed a method for coating carbon particles with a metal oxide or the like by the sol-gel method to enhance the dispersibility of the carbon particles in a composite plating solution of silver and the carbon particles to increase the quantity of the carbon particles in a composite plating film (see, e.g., JP H03-253598 A).

However, composite plated products produced by the methods disclosed in JP H09-007445 A, JP H05-505853 A and JP H03-253598 A have relatively high coefficients of friction, so that there is a problem in that it is not possible to use the composite plated products as the materials of long-life contacts and terminals. Therefore, it is desired to provide a composite plated product which has a larger content of carbon and a higher percentage of an area occupied by carbon particles on the surface thereof than those of the composite plated products produced by the methods disclosed in JP H09-007445 A, JP H05-505853 A and JP H03-253598 A and which has a better wear resistance than that of the composite plated products produced by the methods disclosed in JP H09-007445 A, JP H05-505853 A and JP H03-253598 A.

As methods for producing such composite plated products, there are proposed a method for electroplating a base material using a cyanide-containing silver-plating solution, which contains carbon particles treated by an oxidation treatment, to form a coating film of a composite material, which contains the carbon particles in a silver layer, on the base material (see, e.g., JP 2006-037225 A), a method for electroplating a base material using a cyanide-containing silver-plating solution, which contains carbon particles treated by an electrolytic treatment, to form a coating film of a composite material, which contains the carbon particles in a silver layer, on the base material (see, e.g., JP 2007-016261 A), and a method for electroplating a base material using a composite plating solution prepared by adding carbon particles, which are treated by an silane coupling treatment after being treated by an oxidation treatment, to a silver-plating solution containing silver nitrate and ammonium nitrate, to form a coating film of a composite material, which contains the carbon particles in a silver layer, on the base material (see, e.g., JP 2007-262528 A), and so forth.

However, since a cyanide-containing silver-plating solution is used in the methods disclosed in JP 2006-037225 A and JP 2007-016261 A, it is required to carry out an effluent treatment for an aqueous solution containing cyanides, so that the costs for a drainage facility are high. Since Ag is deposited as dendrite-shaped by electroplating in a silver-plating bath containing silver nitrate and ammonium nitrate in the method disclosed in JP 2007-262528 A, there is some possibility that the uneven appearance of a composite plated product is large. In addition, the long-term stability of the silver-plating bath is bad, so that the method is unsuited for the mass-production of composite plated products.

SUMMARY OF THE INVENTION

It is therefore an object of the present invention to eliminate the aforementioned problems and to provide a composite plated product, which has little uneven appearance and good wear resistance, and a method for producing the same without the need of any cyanide-containing silver-plating solutions and any silver-plating solutions containing silver nitrate as a silver salt.

In order to accomplish the aforementioned and other objects, the inventors have diligently studied and found that it is possible to provide a composite plated product, which has little uneven appearance and good wear resistance, and a method for producing the same without the need of any silver-plating solutions containing cyanides and any silver-plating solutions containing silver nitrate as a silver salt, if a composite plating film of a composite material, which contains carbon particles in a silver layer, is formed on a base material by electroplating the base material using a sulfonic-acid-containing silver-plating solution (which is one of cyanide-less silver-plating solutions), to which a carbon particle dispersing solution (which is a dispersing solution of the carbon particles) is added. Thus, the inventors have made the present invention.

According to the present invention, there is provided a method for producing a composite plated product, the method comprising the steps of: preparing a carbon particle dispersing solution, in which carbon particles are dispersed; adding the carbon particle dispersing solution to a sulfonic-acid-containing silver-plating solution; and forming a composite plating film of a composite material, which contains the carbon particles in a silver layer, on a base material by electroplating the base material using the sulfonic-acid-containing silver-plating solution to which the carbon particle dispersing solution is added.

In this method for producing a composite plated product, the carbon particle dispersing solution preferably contains a silicate. The carbon particles are preferably graphite particles having an average particle diameter of 1 to 15 μm. The amount of the carbon particles, which are added to the sulfonic-acid-containing silver-plating solution, is preferably in the range of from 10 g/L to 100 g/L. The electroplating for forming the composite plating film is preferably carried out at a current density of 1 to 20 A/dm$^2$. The base material is preferably made of copper or a copper alloy. Before the composite plating film of the composite material is formed, a nickel-plating film may be formed on the base material.

According to the present invention, there is provided a composite plated product comprising: a base material; and a composite plating film of a composite material which contains carbon particles in a silver layer, the composite plating film being formed on the base material, wherein the percentage of an area occupied by the carbon particles on the surface of the composite plating film is in the range of from 30 area % to 90 area %, and wherein the composite plating film contains silicon.

In this composite plated product, the content of silicon in the composite plating film is preferably in the range of from 0.01% by weight to 1% by weight. The composite plating film preferably has a thickness of 0.5 to 20 μm. Furthermore, a nickel-plating film may be formed between the composite plating film and the base material.

According to the present invention, it is possible to provide a composite plated product, which has little uneven appearance and good wear resistance, and a method for producing the same without the need of any cyanide-containing silver-plating solutions and any silver-plating solutions containing silver nitrate as a silver salt.

DESCRIPTION OF THE PREFERRED EMBODIMENTS

In the preferred embodiment of a method for producing a composite plated product according to the present invention, a sulfonic-acid-containing silver-plating solution (which is a silver-plating solution containing at least one sulfonic acid), which contains a carbon particle dispersing solution (which is a dispersing solution of carbon particles), is used for electroplating a base material (preferably made of copper or a copper alloy) to form a composite plating film of a composite material, which contains the carbon particles in a silver layer, on the base material. Although it is not possible to cause carbon particles to be incorporated in a plating film if only the carbon particles are added to be suspended in a silver-plating solution, it is possible to improve the dispersibility of the carbon particles in the silver-plating solution if the carbon particle dispersing solution is added to the sulfonic-acid-containing silver-plating solution as this preferred embodiment.

The carbon particle dispersing solution is a dispersing solution, in which carbon particles are dispersed in a dispersing medium. The dispersing medium is preferably water. The carbon particle dispersing solution preferably contains a silicate such as potassium silicate. The amount of the silicate is preferably 5 to 20% by weight, and more preferably 10 to 15% by weight. The carbon particle dispersing solution may contain a dispersing agent in order to improve the dispersability of the carbon particles in the carbon particle dispersing solution. This dispersing agent may be a dispersing agent capable of preventing the sedimentation for the carbon particles. For example, the dispersing agent may be any one of anionic dispersing agents such as methyl cellulose and carboxymethyl cellulose, non-ionic dispersing agents such as polyoxyethylene alkyl ethers, and cationic dispersing agents such as sodium alkylbenzene sulfonate. Furthermore, when the carbon particle dispersing solution is allowed to stand for 5 minutes after the carbon particles are dispersed in the dispersing medium by stirring, 90% or more of the carbon particles preferably maintain the dispersing state thereof. The carbon particles are preferably graphite particles. The average particle diameter of the graphite particles is preferably 0.5 to 15 μm, and more preferably 1 to 10 μm.

The sulfonic-acid-containing silver-plating solution may contain a silver sulfonate serving as Ag ion source, a sulfonic acid serving as a complexing agent, and an addition agent such as a brightener. The concentration of Ag in the silver-plating solution is preferably 5 to 150 g/L, more preferably 10 to 120 g/L and most preferably 20 to 100 g/L. As the silver sulfonate contained in the sulfonic-acid-containing silver-plating solution, there may be used silver methanesulfonate, silver alkanolsulfonate, silver phenolsulfonate or the like.

The amount of the carbon particles, which are added to the sulfonic-acid-containing silver-plating solution, is preferably in the range of from 10 g/L to 100 g/L, more preferably in the range of from 20 to 90 g/L and most preferably in the range of from 30 to 80 g/L. If the amount of the carbon particles in the sulfonic-acid-containing solution is less than 10 g/L, there is some possibility that it is not possible to sufficiently increase the content of the carbon particles in the composite plating layer. Even if the amount of the carbon particles in the silver-plating solution exceeds 100 g/L, it is not possible to further increase the content of the carbon particles in the composite plating layer.

The current density during electroplating for forming the composite plating film is preferably 1 to 20 A/dm$^2$, and more preferably 2 to 15 A/dm$^2$. If the concentration of Ag and the current density are too low, the composite plating film is slowly formed, so that it is not possible to efficiently form the composite plating film. If the concentration of Ag and the current density are too high, the uneven appearance of the composite plating film is easily caused.

If the carbon particle dispersing solution is thus added to a sulfonic-acid-containing silver-plating solution, it is possible to improve the dispersibility of the carbon particles in the silver-plating solution. If this silver-plating solution is used for electroplating, it is possible to produce a composite plated product wherein a composite plating film of a composite material, which contains carbon particles dispersed in a silver layer, is formed on a base material and wherein the percentage of an area occupied by the carbon particles on the surface thereof is high, the composite plated product having good wear resistance.

In the preferred embodiment of a composite plated product according to the present invention, a composite plating film of a composite material, which contains carbon particles in a silver layer, is formed on a base material (preferably made of copper or a copper alloy), and the percentage of an area occupied by the carbon particles on the surface of the composite plating film is in the range of from 30 area % to 90 area % (preferably from 40 area % to 85 area %), the composite plated product containing (preferably 0.01 to 1% by weight and more preferably 0.05 to 0.3% by weight of) Si. If the percentage of the area occupied by the carbon particles on the surface of the composite plating film is less than 30 area %, the wear resistance of the composite plated product is insufficient. If the percentage of the area occupied by the carbon particles on the surface of the composite plating film exceeds 90 area %, the contact resistance of the composite plated product is increased.

The thickness of the composite plating film is preferably in the range of from 0.5 μm to 20 μm, more preferably in the range of from 3 μm to 10 μm, and most preferably 3 μm to 8 μm. If the thickness of the composite plating film is less than 0.5 μm, the wear resistance of the composite plated product is insufficient. If the thickness of the composite plating film exceeds 20 μm, the amount of silver therein is increased, so that the producing costs of the composite plated product are increased. In order to improve the heat resistance of the composite plated product, a nickel-plating film (preferably having a thickness of 0.5 to 5 μm) may be formed between the composite plating film and the base material.

Furthermore, if two test pieces are cut-off from the preferred embodiment of a composite plated product according to the present invention, one of the test pieces being used as a plate-shaped test piece (an evaluating sample), and the other test piece being indented (semi-spherically punched so as to have an inside R of 1.0 mm) to be used as an indented test piece (indenter), and if the wear resistance of the composite plated product is evaluated by carrying out an abrasion test for confirming the abrasion status of the plate-shaped test piece when the reciprocating sliding movement (sliding distance=10 mm, sliding speed=3 mm/s) is continued until the base material is exposed while the indented test piece is pushed against the plate-shaped test piece at a constant load (2N) by means of a sliding abrasion testing machine, the base material is not preferably exposed after the reciprocating sliding movement is repeated 10,000 times. If forces applied in the horizontal direction during the above-described reciprocating sliding movement are measured to calculate an average value F thereof and if a coefficient (μ) of dynamic friction between the plate-shaped test piece and the indented test piece is calculated from $\mu=F/N$, the coefficient of dynamic friction is preferably 0.5 or less.

Examples of a composite plated product and a method for producing the same according to the present invention will be described below in detail.

Example 1

As a base material, there was prepared a plate material of a Cu—Ni—Sn—P alloy (a plate material of a copper alloy comprising 1.0% by weight of nickel, 0.9% by weight of tin, 0.05% by weight of phosphorus and the balance being copper) (NB-109EH produced by DOWA METALTECHCO., LTD.) having a thickness of 0.2 mm. Then, this base material and a platinized titanium mesh electrode plate (an electrode plate of a mesh material of titanium plated with platinum) were used as a cathode and an anode, respectively, for electroplating (silver-strike-plating) the base material at a current density of 3 A/dm$^2$ for 10 seconds in a sulfonic-acid-containing silver-strike-plating solution (Dyne Silver GPE-ST produced by Daiwa Fine Chemicals Co., Ltd.) containing a sulfonic acid as a complexing agent.

Then, a carbon particle dispersing solution (containing 20% by weight of carbon, 11 to 14% by weight of potassium silicate and a dispersing agent) (PROHITE NS5 produced by Nippon Graphite Industries, Co., Ltd.), in which graphite particles having an average particle diameter of 4 μm serving as carbon particles were dispersed in water, was added to a sulfonic-acid-containing silver-plating solution (containing a sulfonic acid as a complexing agent and having a silver concentration of 80 g/L) (Dyne Silver GPE-PL (dull luster) produced by Daiwa Fine Chemicals Co., Ltd.) so that the concentration of the carbon particle dispersing solution was 260 g/L. Thus, a sulfonic-acid-containing silver-plating solution containing 53 g/L of carbon particles was prepared.

Then, the above-described silver-strike-plated base material and a silver electrode plate were used as a cathode and an anode, respectively, for electroplating (current efficiency=95%) the base material at a temperature of 25° C. and a current density of 3 A/dm$^2$ for 250 seconds in the above-described sulfonic-acid-containing silver-plating solution containing the carbon particle dispersing solution while stirring the solution at 500 rpm. There was thus produced a composite plated product wherein a composite plating film containing carbon particles in a silver-plating layer was formed on the base material.

The thickness of the composite plating film (the area having a diameter of 1.0 mm in the central portion of the composite plating film) of the composite plated product thus obtained was measured by means of an X-ray fluorescent analysis thickness meter (FT9450 produced by Hitachi High-Tech Science Corporation). As a result, the thickness thereof was 6.5 μm.

The surface of a test piece cut-off from the composite plated product was observed to calculate the percentage (area ratio (area %)) of an area occupied by the carbon particles on the surface of the composite plating film. The area ratio of the carbon particles on the surface of the composite plating film was calculated as follows. First, the surface of the test piece was irradiated with electron beams at an irradiation current of $3\times10^{-7}$ A and an accelerating voltage of 15 kV by means of an electron probe microanalyzer (EPMA) (JXA8100 produced by JEOL Ltd.) to obtain a compositional image in BE mode (COMPO image) (at a magnification of 1000) by means of a backscattered electron detector. The binarization of the tone of the COMPO image thus obtained was carried out by means of an image analyzing application (Image Editing/Processing Software GIMP 2.10.6) (so that pixels having a brightness of 127 or less were black and pixels having a brightness of greater than 127 were white assuming that the highest brightness of all of the pixels was 255 and that the lowest brightness thereof was 0). Thus, the COMPO image was divided into portions of silver (white portions) and portions of the carbon particles (black portions). The area ratio of the carbon particles on the surface of the composite plating film was calculated as a ratio Y/X of the number Y of the pixels of the portions of the carbon particles to the number X of the pixels of the whole image. As a result, the percentage (area ratio) of the area occupied by the carbon particles on the surface of the composite plating film was 58 area %. The surface of the composite plating film was observed with the naked eye. As a result, the surface thereof was gray, and no uneven appearance was observed thereon, so that the appearance of the composite plating film was good.

The surface of the composite plated product was irradiated with electron beams at an accelerating voltage of 15 kV and an irradiation current of $3.0\times10^{-7}$ A in an analyzing area having a diameter of 50 μm by means of an electron probe microanalyzer (EPMA) (JXA8100 produced by JEOL Ltd.) to carry out the surface analysis thereof by qualitative and quantitative analysis based on ZAF method. As a result, it was found that 0.2% by weight of Si was contained in the composite plating film.

Then, two test pieces were cut-off from the composite plated product, one of the test pieces being used as a plate-shaped test piece (an evaluating sample), and the other test piece being indented (semi-spherically punched so as to have an inside R of 1.0 mm) to be used as an indented test piece (indenter). Then, the wear resistance of the composite plated product was evaluated by carrying out an abrasion test for confirming the abrasion status of the plate-shaped test piece when the reciprocating sliding movement (sliding distance=10 mm, sliding speed=3 mm/s) was continued until the base material was exposed while the indented test piece was pushed against the plate-shaped test piece at a constant load (2N) by means of a sliding abrasion testing machine (produced by Yamasaki-Seiki Co., Ltd.). After the reciprocating sliding movement was repeated 10,000 times, the central portion of the sliding scratch of the plate-shaped test piece was observed at a magnification of 200 by means of a microscope (VKX-1000 produced by Keyence Corporation). As a result, it was confirmed that the (brown) base material was not exposed. The thickness of the composite plating film (the area having a diameter of 0.1 mm in the central portion of the sliding scratch of the composite plating film) of the plate-shaped test piece was measured by means of an X-ray fluorescent analysis thickness meter (FT9450 produced by Hitachi High-Tech Science Corporation). As a result, the thickness thereof was 5.2 μm, so that it was found that the wear resistance thereof was good. The forces applied in the horizontal direction during the above-described reciprocating sliding movement were measured to calculate an average value F thereof, and the coefficient (μ) of dynamic friction between the plate-shaped test piece and the indented test piece was calculated from μ=F/N. As a result, the coefficient of dynamic friction was 0.30.

Example 2

A composite plated product was produced by the same method as that in Example 1, except that the base material was electroplated (silver-plated) (current efficiency=90%) in a sulfonic-acid-containing silver-plating solution containing 20 g/L of carbon particles, the sulfonic-acid-containing silver-plating solution being prepared by adding the same carbon particle dispersing solution as that in Example 1 to the same sulfonic-acid-containing silver-plating solution as that in Example 1, except that the concentration of Ag in the sulfonic-acid-containing silver-plating solution was 30 g/L, the carbon particle dispersing solution being added to the sulfonic-acid-containing silver-plating solution so that the concentration of the carbon particle dispersing solution was 100 g/L.

The thickness of the composite plating film of the composite plated product thus obtained was measured by the same method as that in Example 1. As a result, the thickness thereof was 5.9 μm.

With respect to the composite plated product, the percentage (area ratio) of the area occupied by the carbon particles on the surface of the composite plating film was calculated by the same method as that in Example 1. As a result, the percentage thereof was 77 area %. The surface of the composite plating film was gray, and no uneven appearance was observed thereon, so that the appearance of the composite plating film was good. The surface analysis of the composite plating film was carried out by the same method as that in Example 1. As a result, it was found that 0.1% by weight of Si was contained in the composite plating film.

The wear resistance of the composite plated product was evaluated by carrying out the sliding abrasion test by the same method as that in Example 1. As a result, it was found that, after the reciprocating sliding movement was repeated 10,000 times, the base material was not exposed, and the thickness of the composite plating film was 5.1 μm, so that the wear resistance thereof was good. The coefficient of dynamic friction between the plate-shaped test piece and the indented test piece was calculated by the same method as that in Example 1. As a result, the coefficient of dynamic friction was 0.34.

Example 3

A composite plated product was produced by the same method as that in Example 1, except that the base material was electroplated (silver-plated) (current efficiency=95%) in a sulfonic-acid-containing silver-plating solution containing 64 g/L of carbon particles, the sulfonic-acid-containing silver-plating solution being prepared by adding a carbon particle dispersing solution (containing 24% by weight of carbon, a small amount of a silicate, a dispersing agent and a thickener) (PROHITE S-2 produced by Nippon Graphite Industries, Co., Ltd.), in which graphite particles having an average particle diameter of 2 μm serving as carbon particles were dispersed in water, to the same sulfonic-acid-containing silver-plating solution as that in Example 1.

The thickness of the composite plating film of the composite plated product thus obtained was measured by the same method as that in Example 1. As a result, the thickness thereof was 5.8 μm.

With respect to the composite plated product, the percentage (area ratio) of the area occupied by the carbon particles on the surface of the composite plating film was calculated by the same method as that in Example 1. As a result, the percentage thereof was 79 area %. The surface of the composite plating film was gray, and no uneven appearance was observed thereon, so that the appearance of the composite plating film was good. The surface analysis of the composite plating film was carried out by the same method as that in Example 1. As a result, it was found that 0.2% by weight of Si was contained in the composite plating film.

The wear resistance of the composite plated product was evaluated by carrying out the sliding abrasion test by the same method as that in Example 1. As a result, it was found that, after the reciprocating sliding movement was repeated 10,000 times, the base material was not exposed, and the thickness of the composite plating film was 4.6 μm, so that the wear resistance thereof was good. The coefficient of dynamic friction between the plate-shaped test piece and the indented test piece was calculated by the same method as that in Example 1. As a result, the coefficient of dynamic friction was 0.21.

Example 4

A composite plated product was produced by the same method as that in Example 1, except that a plate of a tough pitch steel (C1100H) having a thickness of 0.3 mm was prepared as a base material to be silver-strike-plated and electroplated (silver-plated) by the same methods as those in Example 1 after the base material and a nickel electrode plate were used as a cathode and an anode, respectively, for electroplating (nickel-plating) the base material at a liquid temperature of 45° C. and a current density of 4 A/dm$^2$ for 140 seconds during stirring in a nickel-plating bath containing 80 g/L of nickel aminosulfonate and 45 g/L of boric acid to form a nickel plating film having a thickness of 1.0 mm on the base material.

The thickness of the composite plating film of the composite plated product thus obtained was measured by the same method as that in Example 1. As a result, the thickness thereof was 5.1 μm.

With respect to the composite plated product, the percentage (area ratio) of the area occupied by the carbon particles on the surface of the composite plating film was calculated by the same method as that in Example 1. As a result, the percentage thereof was 57 area %. The surface of the composite plating film was gray, and no uneven appearance was observed thereon, so that the appearance of the composite plating film was good. The surface analysis of the composite plating film was carried out by the same method as that in Example 1. As a result, it was found that 0.2% by weight of Si was contained in the composite plating film.

The wear resistance of the composite plated product was evaluated by carrying out the sliding abrasion test by the same method as that in Example 1. As a result, it was found that, after the reciprocating sliding movement was repeated 10,000 times, the base material was not exposed, and the thickness of the composite plating film was 4.1 μm, so that the wear resistance thereof was good. The coefficient of dynamic friction between the plate-shaped test piece and the indented test piece was calculated by the same method as that in Example 1. As a result, the coefficient of dynamic friction was 0.35.

Comparative Example 1

A composite plated product was produced by the same method as that in Example 1, except that the base material was electroplated (silver-plated) (current efficiency=95%) in a sulfonic-acid-containing silver-plating solution containing 80 g/L of hydrophobic carbon particles, the sulfonic-acid-containing silver-plating solution being prepared by adding hydrophobic dry carbon particles having an average particle diameter of 5 μm (SN-5 produced by SEC Carbon Limited) in place of the carbon particle dispersing solution to the same sulfonic-acid-containing silver-plating solution as that in Example 1 so that the concentration of the carbon particles was 80 g/L.

The thickness of the composite plating film of the composite plated product thus obtained was measured by the same method as that in Example 1. As a result, the thickness thereof was 5.5 μm.

With respect to the composite plated product, the percentage (area ratio) of the area occupied by the carbon particles on the surface of the composite plating film was calculated by the same method as that in Example 1. As a result, the percentage thereof was 8 area %. The surface of the composite plating film was mat white, and no uneven appearance was observed thereon. The surface analysis of the composite plating film was carried out by the same method as that in Example 1. As a result, the content of Si in the composite plating film was 0% by weight.

The wear resistance of the composite plated product was evaluated by carrying out the sliding abrasion test by the same method as that in Example 1. As a result, it was found that, after the reciprocating sliding movement was repeated 10,000 times, the base material was exposed, and the thickness of the composite plating film was 0 μm, so that the wear resistance thereof was not good. The coefficient of dynamic friction between the plate-shaped test piece and the indented test piece was calculated by the same method as that in Example 1. As a result, the coefficient of dynamic friction was 1.10.

Comparative Example 2

A composite plated product was produced by the same method as that in Example 1, except that a cyanide-containing silver-plating solution containing 3 g/L of silver potassium cyanide and 100 g/L of potassium cyanide was used in place of the sulfonic-acid-containing silver-strike-plating solution for electroplating (silver-strike-plating) the base material and that a cyanide-containing silver-plating solution containing 100 g/L of silver potassium cyanide, 120 g/L of potassium cyanide and 4 mg/L of potassium selenocyanate was used in place of the sulfonic-acid-containing silver-plating solution for electroplating (silver-plating) (current efficiency=95%) the base material.

The thickness of the composite plating film of the composite plated product thus obtained was measured by the same method as that in Example 1. As a result, the thickness thereof was 5.6 μm.

With respect to the composite plated product, the percentage (area ratio) of the area occupied by the carbon particles on the surface of the composite plating film was calculated by the same method as that in Example 1. As a result, the percentage thereof was 0 area %. The surface of the composite plating film was glossy whitish silver, and no uneven appearance was observed thereon. The surface analysis of the composite plating film was carried out by the same method as that in Example 1. As a result, the content of Si in the composite plating film was 0% by weight.

The wear resistance of the composite plated product was evaluated by carrying out the sliding abrasion test by the same method as that in Example 1. As a result, it was found that, after the reciprocating sliding movement was repeated 10,000 times, the base material was exposed, and the thickness of the composite plating film was 0 μm, so that the wear resistance thereof was not good. The coefficient of dynamic friction between the plate-shaped test piece and the indented test piece was calculated by the same method as that in Example 1. As a result, the coefficient of dynamic friction was 1.20.

The producing conditions and characteristics of the composite plated products in these examples and comparative examples are shown in Tables 1 through 3.

TABLE 1

| | Base Material | Thickness of Ni Plating Film (μm) | Ag Strike Plating Bath |
|---|---|---|---|
| Ex. 1 | NB109EH (T: 0.2 mm) | — | Sulfonic Acid Bath |
| Ex. 2 | NB109EH (T: 0.2 mm) | — | Sulfonic Acid Bath |
| Ex. 3 | NB109EH (T: 0.2 mm) | — | Sulfonic Acid Bath |
| Ex. 4 | C1100H (T: 0.3 mm) | 1.0 | Sulfonic Acid Bath |
| Comp. 1 | NB109EH (T: 0.2 mm) | — | Sulfonic Acid Bath |
| Comp. 2 | NB109EH (T: 0.2 mm) | — | Cyanide Bath |

TABLE 2

| | Composite Plating Bath | | | Thickness of Composite |
|---|---|---|---|---|
| | Ag Plating Bath | Concentration of Ag (g/L) | Carbon Particles | Plating Film (μm) |
| Ex. 1 | Sulfonic Acid Bath | 80 | hydrophilic | 6.5 |
| Ex. 2 | Sulfonic Acid Bath | 30 | hydrophilic | 5.9 |

TABLE 2-continued

| | Composite Plating Bath | | | Thickness of Composite |
|---|---|---|---|---|
| | Ag Plating Bath | Concentration of Ag (g/L) | Carbon Particles | Plating Film (μm) |
| Ex. 3 | Sulfonic Acid Bath | 80 | hydrophilic | 5.8 |
| Ex. 4 | Sulfonic Acid Bath | 80 | hydrophilic | 5.1 |
| Comp. 1 | Sulfonic Acid Bath | 80 | hydrophobic | 5.5 |
| Comp. 2 | Cyanide Bath | 80 | hydrophilic | 5.6 |

TABLE 3

| | | | After Sliding Wear Test | | |
|---|---|---|---|---|---|
| | Proportion of C on Surface (area %) | Si (wt %) | Exposure | Thickness of Composite Plating Film (μm) | Coefficient of Friction |
| Ex. 1 | 58 | 0.2 | not exposed | 5.2 | 0.30 |
| Ex. 2 | 77 | 0.1 | not exposed | 5.1 | 0.34 |
| Ex. 3 | 79 | 0.2 | not exposed | 4.6 | 0.21 |
| Ex. 4 | 57 | 0.2 | not exposed | 4.1 | 0.35 |
| Comp. 1 | 8 | 0 | exposed | 0 | 1.10 |
| Comp. 2 | 0 | 0 | exposed | 0 | 1.20 |

What is claimed is:

1. A composite plated product comprising:

a base material; and a composite plating film of a composite material which contains 0.01 to 1% by weight of silicon and which contains carbon particles in a silver layer, the composite plating film being formed on the base material, the carbon particles having an average particle diameter of 2 to 15 μm, wherein the percentage of an area occupied by the carbon particles on the surface of the composite plating film is in the range of from 30 area % to 90 area %.

2. A composite plated product as set forth in claim 1, wherein said composite plating film has a thickness of 0.5 to 20 μm.

3. A composite plated product as set forth in claim 1, which further comprises a nickel-plating film formed between said composite plating film and said base material.

4. A composite plated product as set forth in claim 1, wherein said carbon particles are graphite particles.

5. A composite plated product as set forth in claim 1, wherein said base material is made of copper or a copper alloy.

6. A composite plated product as set forth in claim 1, wherein said percentage is in the range of from 40 area % to 85 area %.

7. A composite plated product as set forth in claim 1, wherein said percentage is in the range of from 57 area % to 85 area %.

* * * * *